United States Patent [19]

Alba et al.

[11] Patent Number: 4,546,306

[45] Date of Patent: Oct. 8, 1985

[54] VOLTAGE STABILIZING TRANSFORMER

[76] Inventors: Emilio C. Alba, Condado de Trevino 12; Angel R. Pacho, Paseo de la Habana 40, both of Madrid, Spain

[21] Appl. No.: 161,448

[22] Filed: Jun. 20, 1980

[30] Foreign Application Priority Data

Jul. 10, 1979 [ES] Spain ..... 482374

[51] Int. Cl.[4] ..... G05F 3/06

[52] U.S. Cl. ..... 323/308; 315/254; 315/276; 315/282; 336/83

[58] Field of Search ..... 315/254, 276, 280, 282; 323/248, 250, 329, 308; 336/83

[56] References Cited

U.S. PATENT DOCUMENTS

| | | | |
|---|---|---|---|
| 2,611,885 | 9/1952 | Bridges | 315/254 X |
| 3,059,143 | 10/1962 | Sola | 315/254 X |
| 3,392,310 | 7/1968 | Feinberg | 315/282 X |
| 3,602,859 | 8/1971 | Dao | 336/83 |
| 3,949,268 | 4/1976 | von Mangoldt | 315/254 X |

*Primary Examiner*—William H. Beha, Jr.
*Attorney, Agent, or Firm*—Pennie & Edmonds

[57] ABSTRACT

An improved magnetic core transformer for use as a voltage stabilizer in gas discharge lamps and tube circuits. The transformer has a magnetic stack length greater than either side of the magnetic cross-section and a floating shunt assembly constructed from stacks of magnetic strips. The stack length is optimized technically and as a function of the cost of iron and copper utilized in the transformer and when conformed with an optimum shunt a greater leakage inductance variation is achieved.

6 Claims, 13 Drawing Figures

VOLTAGE STABILIZING TRANSFORMER

BACKGROUND OF THE INVENTION

1. Field of Invention

The present invention relates to voltage stabilizing magnetic core transformers of the type used to energize gas filled lamps and lighting tubes.

2. Background Art

Magnetic transformers have been used for voltage regulation in the ballast circuits of fluorescent and other gas filled discharge lamps for a number of years. The problems associated with the use of magnetic core transformers for this purpose usually involve the high cost of the iron and copper materials used in the manufacture of these devices. These problems are aggravated by the fact that proper operation of a voltage regulator or stabilizing transformer requires a magnetic shunt and air gap in the magnetic circuit of the transformer, which complicates the shape of the iron core elements.

One solution to the above problems has been to assemble the magnetic core from magnetic sheets or stampings which include the shunt as an integral part of the central winding core. An example of this type of construction is found in Spanish Pat. No. 352,884 of Aug. 1, 1969. That patent discloses a transformer of essentially square cross-section with a stack length governed by the formula that the ratio of the stack length to twice the sum of the sides of the stack cross-section is equal to or greater than 0.25 and wherein the coils are wound in a plane parallel to the stack length. In addition, the shunt piece is an integral part of the winding core thus providing a shorter magnetic circuit length and greater dispersion through the shunt as opposed to the windings. This design is said to produce significant improvements in stabilization over previous designs when used with a capacitive reactance in the secondary circuit.

FIGS. 1 and 2 show the two types of magnetic stabilizers that are presently used and manufactured. These two types of magnetic stabilizers are basically the same in concept, the use of either depending on the dimensions of the lamp or tube for which they are to be employed. As can be seen in these figures, the physical difference is in dimension "A", which solely affects the length of the magnetic circuit, the magnetic core section being the same in both models.

The stabilizing transformer of the present invention provides a significant improvement over existing designs in that the stack length is much greater than in previous designs and is technically and economically determined by optimizing the stack length in terms of operation and material costs, this is combined with a floating magnetic shunt, both of which providing a greater leakage inductance variation with respect to the primary voltage and thus a much wider range of stabilization.

SUMMARY OF INVENTION

The invention is an improved voltage stabilizing magnetic core transformer which has a greater stack length than transformers of the prior art combined with a floating magnetic shunt. The greatly increased stack length is optimized in terms of operation and material costs thereby significantly reducing the weight of copper and increasing the useful power as a result of the concomitant reduction in winding losses.

The unique and flexible floating magnetic shunt of the invention is formed from parallel stacks of magnetic strips placed between the primary and secondary windings and abutting the winding core.

The stabilizing transformer of the invention provides higher useful power than a standard stabilizing transformer because the winding losses are reduced due to the optimization of the amount of copper used for a given transformer application.

Greater stability under wide conditions of supply voltage variation is also achieved in the stabilizing transformer of the invention because the leakage inductance variation with respect to the supply voltage variation is greater as a result of the unique magnetic arrangement design. This arrangement provides superior flexibility due to the shape and assembly of sheets, allowing cost savings in materials as well as electromagnetic regulation of the electrical characteristics of the core/windings combination which permits perfect adaptation of the stabilizing transformer to each type of lamp. This cannot be achieved with conventional stabilizing transformers which have fixed shunts and shorter stack length.

DETAILED DESCRIPTION OF THE INVENTION

Figure 1:
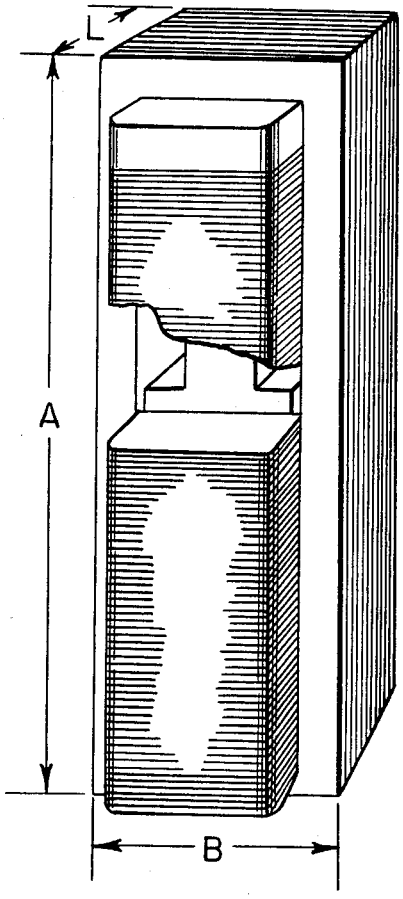
FIG. 1 (Prior Art)
FIG. 1 is a perspective view of one configuration of a stabilizing transformer of the prior art.
Figure 2:
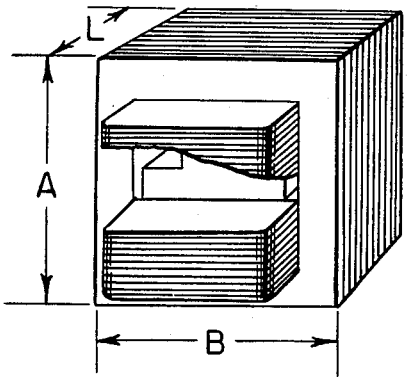
FIG. 2 (Prior Art)
FIG. 2 is a perspective view of another configuration of a stabilizing transformer of the prior art.

Referring to FIGS. 1 and 2 there is shown two types of magnetic stabilizers that are presently used and manufactured. These two types of magnetic stabilizers are basically the same in concept, the use of either depending on the dimensions of the lamp or tube for which they are to be employed. As can be seen in these figures, the physical difference is in dimension "A", which solely affects the length of the magnetic circuit, the magnetic core section being the same in both models.

Figure 3:
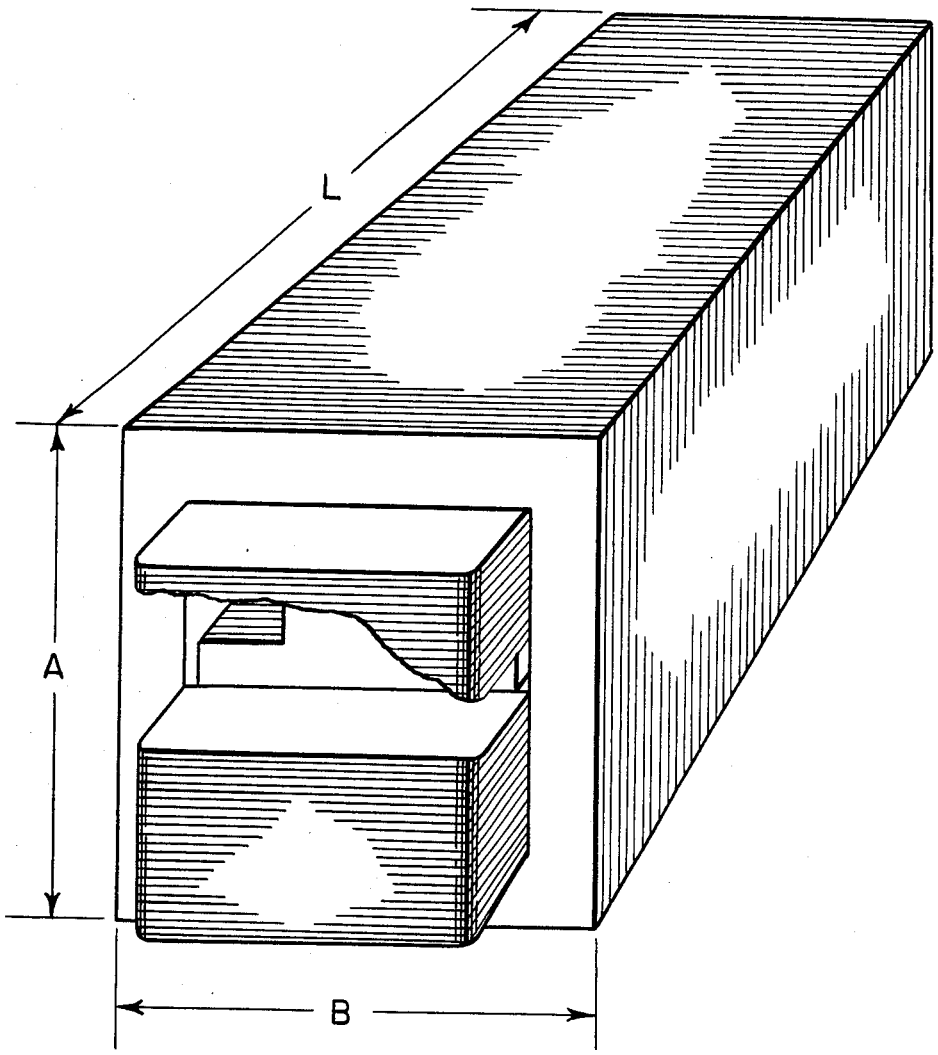
FIG. 3 is a perspective view of a stabilizing transformer in accordance with the invention.

Referring now to FIG. 3, there is shown a perspective view of a stabilizing transformer according to the invention. As can be seen the stack length (L) is much greater in the stabilizing transformer of FIG. 3 than those of either FIG. 1 or 2. Thus, the magnetic core section of the stabilizing transformer of the invention is greater than that of the conventional transformer resulting in greatly improved reactance operation at significant savings in cost.

In equivalent magnetic transformers, for a given magnetic induction and effective voltage, the number of turns N multiplied by the magnetic core section S is constant, hence the weight of the copper windings is inversely proportional to the stack length, and the opposite occurs with the weight of iron which is directly proportional to the stack length.

From an economical point of view the optimum stack length is that with which the combined cost of the iron and copper is minimum. This stack length differs greatly from currently known stabilizing transformers. Since it is possible to save a considerable amount of copper by increasing that length, thus, taking into account that the increase in cost of iron is more than offset by the decrease in cost of copper, the reactance material cost is appreciably less for the optimum stack length.

Figure 4:
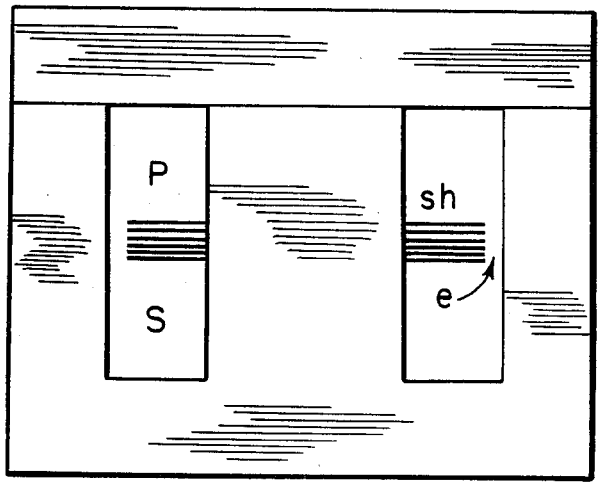
FIG. 4 is a cross-section view of one embodiment of the construction of the magnetic circuit of the stabilizing transformer of the invention.
Figure 5:
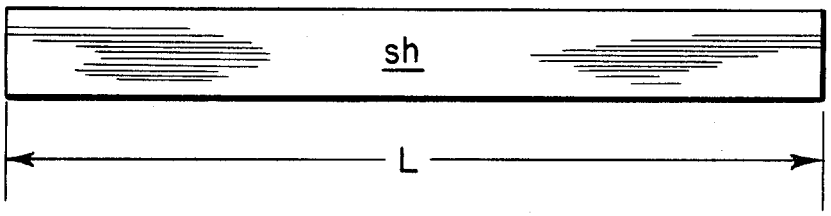
FIG. 5 is a plan view of a magnetic strip of the type used to form the shunt of the stabilizing transformer of the invention.

FIG. 4 which shows, a "scrapless" type magnetic sheet and strip assembly model for the core of a stabilizing transformer according to the invention, which together with the shunt strip sh, shown in FIG. 5, of the same length as the stack length L, has the following constructive advantages in the magnetic cores of the subject invention.

As the shunt strip sh is separate, the number of strips necessary to obtain the optimum section can be employed, also the width of this strip can be precisely that required to obtain the necessary air gap in each case. As these shunt strips are not fixed to the core sheets, they can be floated at the appropriate height in order to obtain the necessary dimensions in the P and S window cross-sections for containing the primary and secondary windings.

This flexibility, due to the shape and assembly of sheets, allows, besides cost savings in materials, the electromagnetic regulation of the electrical characteristics of the core/windings combination, which permits perfect adaptation of the stabilizer operation to each type of lamp. This can not be achieved with the conventional models as the shunt is a fixed part of the same piece as the sheet.

EXAMPLE I

Figure 6:
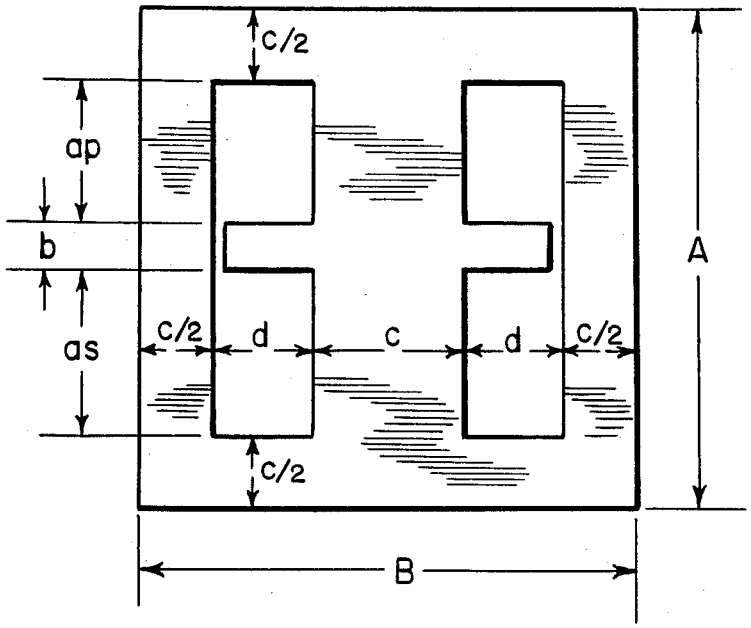
FIG. 6 is sectional view of the magnetic circuit of a stabilizing transformer according to the invention.
Figure 7:
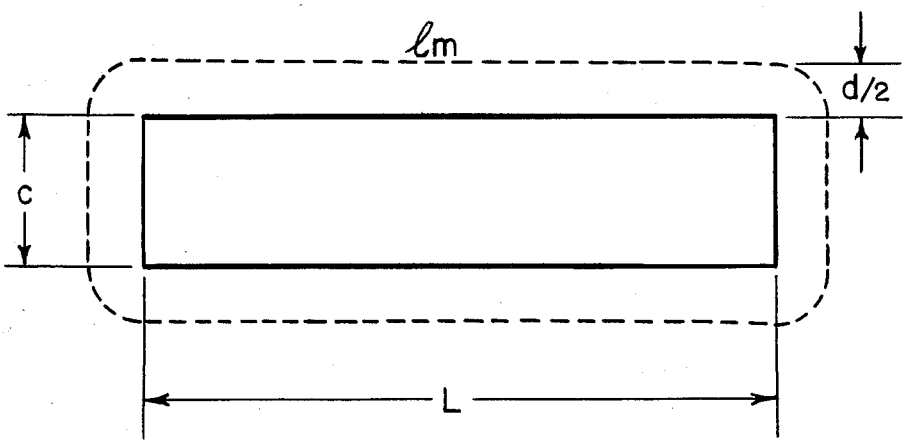
FIG. 7 shows the mean turn length of the copper winding of a stabilizing transformer according to the invention.

With reference to FIGS. 6 and 7, it can be seen that the reactance, as well as the copper and iron weights for a stabilizing transformer according to the invention are determined by the following factors:

Stack length; L
Primary window height; ap
Secondary window height; as
Shunt stack height; b
Vertical dimension of the magnetic sheet; A
Core width; c
Primary and secondary window width; d
Horizontal dimension of the magnetic sheet; B
Primary wire diameter; $D_p$
$\underline{N}p \times \underline{S}p$ = Primary turns × primary core cross-section
$\underline{N}s \times \underline{S}s$ = Secondary turns × secondary core cross-section $$\text{Coil factors} = \frac{\text{Copper cross-section}}{\text{Window cross-section}}$$

Copper density; ρcu
Iron density; ρfe

The following values have been used for this example:

L = variable
ap = f(L)
as = f(L)
b = 0.8 cm
c = 2.5 cm
d = 1.6 cm
Dp = 0.08 cm diameter
Ds = 0.075 cm diameter
Np × Sp = 8,775
Ns × Ss = 14,950
ρcu = 8.9 gr/cm$^3$
ρfe = 7.6 gr/cm$^3$ Using those values the gross Iron weight is:

Winding factor of the primary windings:

$$Fbp = \frac{Np \times \text{primary wire cross-section}}{\text{Primary window cross-section}} = 0.38556$$

Winding factor of the secondary windings:

$$Fbs = \frac{Ns \times \text{secondary wire cross-section}}{\text{Secondary window cross-section}} = 0.4704$$

The height of the primary and secondary windows in function of the stack length L are:

$$Svp = \frac{Np \times \text{primary wire section}}{Fbp} = \frac{45.76}{L}\ \text{cm}^2$$

$$\text{Primary window height} = \frac{45.76}{1.6\,L} = \frac{28.6}{L}\ \text{cm}$$

$$Svp = \frac{Np \times \text{secondary wire cross-section}}{Fbs} = \frac{56.16}{L}\ \text{cm}^2$$

$$\text{Secondary window height} = \frac{56.16}{1.6\,L} = \frac{35.1}{L}\ \text{cm}$$

The total cross-section height will be:

$$A = 2.5 + 0.8 + \frac{28.6}{L} + \frac{35.1}{L}\ \text{cm}$$

Using a theoretical stack factor of 0.9 gives:

Gross weight Fe = 0.9 × L × 8.2 × A × 7.6 gr.

Gross weight Fe = 185.0904L + 3,572.8 gr.

Using the above values the weight of copper is:

Pcu = 1 m (Np × primary wire section + $N_s$ × secondary wire section × 8.9) where 1 m, the mean line length of the turn, FIG. 7 is the same for the primary as for the secondary windings.

Upon substituting values:

$$Pcu = \frac{3{,}931.7}{L} + 811.3\ \text{grams}$$

Using the above derived formulas the cost of copper and iron may be calculated as:

Using Spanish pesetas of 54 pts/kg ($0.82/kg) as the cost of iron sheets and 450 pts/kg ($6.82/kg) as that of copper, we obtain:

$$Pt = 10\,L + \frac{1{,}760}{L} + 558\ pts.\left(Pt = 0.15\,L + \frac{26.80}{L} + \$8.45\right)$$

The minimum price therefore is:
the L value that makes $$\frac{d\,Pt}{dl}$$

zero
Thus:

$$\frac{d\,Pt}{dl} = 10 - \frac{1{,}760}{L^2};$$

which corresponds to a stack length of 13.3 cm resulting in a minimum cost of 824 pts ($12.50).

Figure 8:
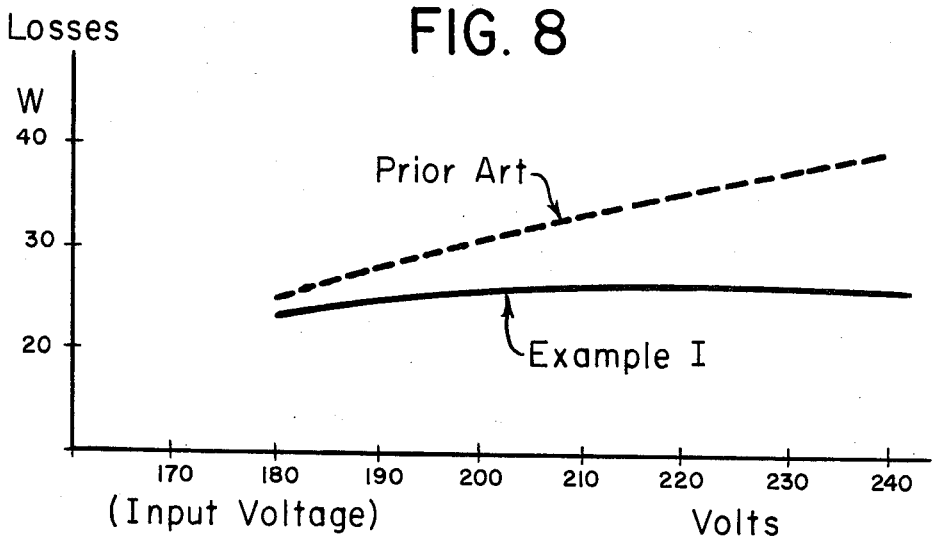
FIG. 8 is a graph of losses in watts versus primary voltage for a stabilizing transformer according to the invention compared to a conventional transformer.
Figure 9:
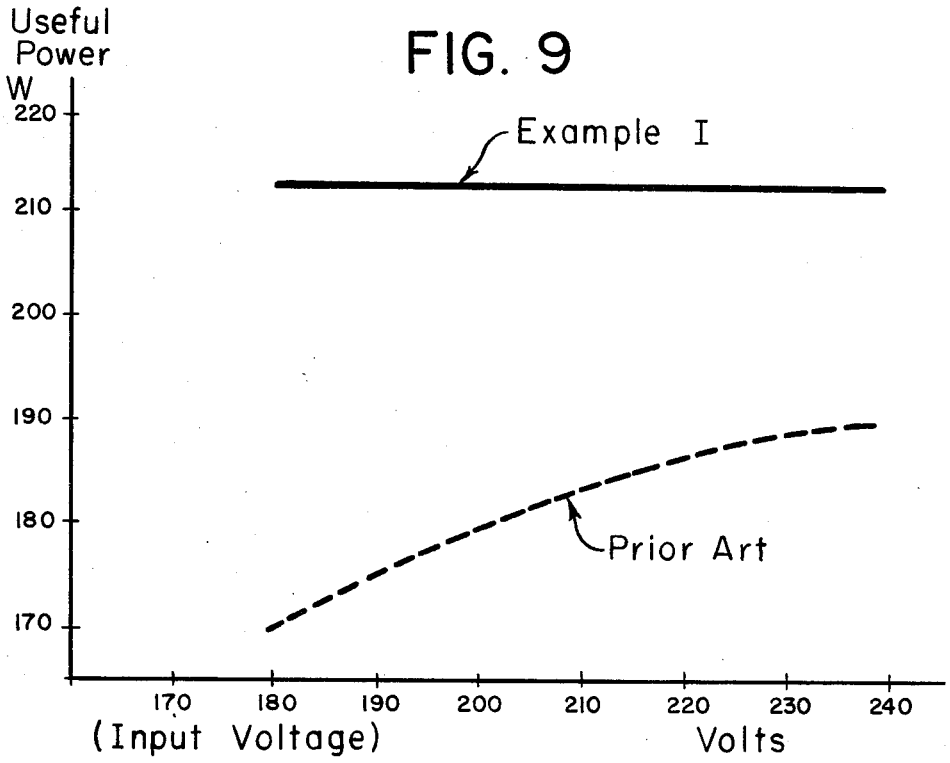
FIG. 9 is a graph of useful power versus primary voltage for a stabilizing transformer according to the invention compared to a conventional transformer.

The results of laboratory tests of a stabilizing transformer built using the values of Example I are shown in FIGS. 8 and 9 which indicate losses and useful power, respectively, of the stabilizing transformer of Example I (continuous line) and a conventional stabilizing transformer (dotted line), as a function of the input voltage.

EXAMPLE II

Figure 10:
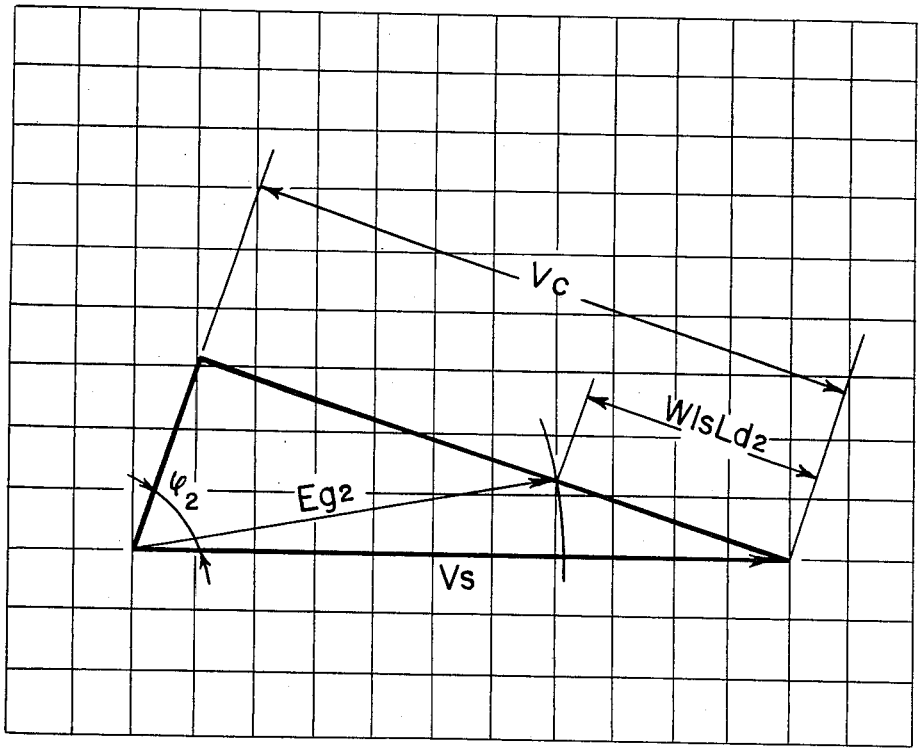
FIG. 10 is a vector diagram of the voltages and currents for a stabilizing transformer according to the invention.
Figure 11:
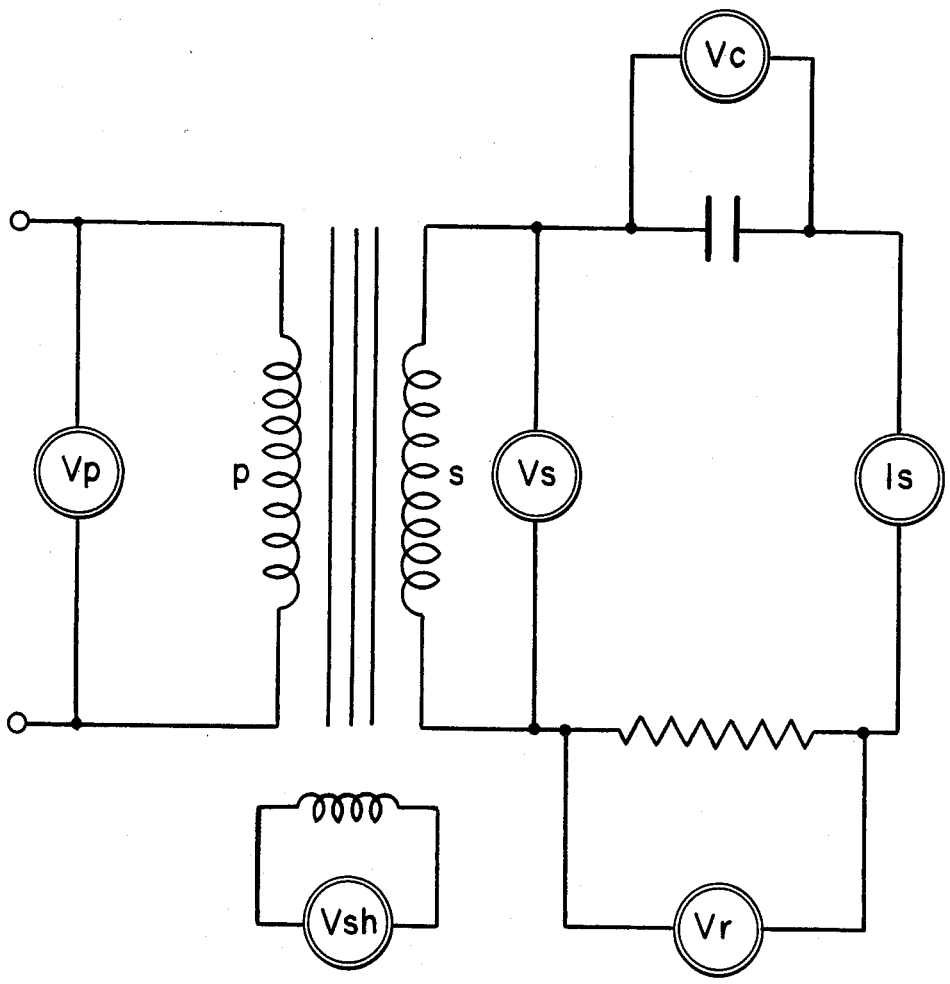
FIG. 11 is a schematic diagram of a circuit used to obtain the graphs of FIGS. 8 and 9.

The influence of Leakage Inductance variation on the stabilization characteristics of the transformer of the invention may be represented graphically as is shown in FIG. 10. This graph is a vector diagram of the secondary winding open-circuit and load voltages, as well as the voltage drops due to the condenser, and leakage inductance, and the angle between the voltage and current of the secondary under load. This graph was made by using the values obtained from tests performed in accordance with the circuit shown in FIG. 11. In these figures the symbols represent:

Vp=primary winding terminal voltage
Vs=secondary winding terminal voltage
Vr=substitute resistance terminal voltage(*)
Vc=condenser terminal voltage
Vsh=shunt terminal voltage (independent winding)(**)

(*)A resistance is used as a substitute for the lamps in order to avoid distortion of the current and voltage waves as much as possible.
(**)The shunt voltage was measured in order to calculate the magnetic flux through its cross-section by means of a pilot winding separate from the primary and secondary windings.

$Eg_2$=secondary winding open circuit voltage
Is=secondary winding current
$\theta 2$=angle between Is and Vs
$Ld_2$=secondary leakage inductance
$w=100\pi$ From FIG. 10 it can be seen that the leakage inductance must have a limited value since if it is very high, the secondary terminal voltage will also be high, as well as the resistance and condenser voltages, producing greater wave deformation and higher losses, therefore affecting the reactance operation. In the same figure it is seen that, if upon an increase in the primary voltage and consequently in the secondary open-circuit voltage, there is not an appreciable decrease in the value of the leakage inductance $Ld_2$, the stabilization is not correct as the aforementioned same negative effects are produced.

The simplified expression to calculate the leakage inductance Ld, assuming that the leakage magnetic circuit has a constant section is:

$$Ld = \frac{\mu_o N^2}{\frac{ld}{\mu \times c \times L} + \frac{e}{b \times L}} \tag{1}$$

where:
Ld=leakage inductance (henries)
N=number of turns
L=stack length (cm)
ld=leakage magnetic path length (cm)
c=core width (cm)
b=shunt stack height (cm)
e=air gap (cm)
$\mu_o$=absolute permeability of vacuum (Ω s/cm)
$\mu$=relative permeability of core For sufficiently low induction values, the term $$\frac{ld}{\mu \times c \times L}$$

may be disregarded compared to $$\frac{e}{b \times L},$$

therefore simplified:

$$Ld = K\frac{N^2 \times L}{e} \tag{2}$$

K being constant for equal shunt stack heights.

In a similar manner, for an equivalent reactance with the same core width, shunt stack height and permeability $\mu$, $Ld_1$ would be:

$$Ld_1 = K\frac{N_1^2 \times L_1}{e_1} \tag{3}$$

Making (2) and (3) equal gives:

$$\frac{N^2 L}{e} = \frac{N_1 2 L_1}{e_1} \tag{4}$$

and as it is necessary that:

$$N \times S = N_1 \times S_1 \tag{5}$$

and since $$S = c \times L \tag{6}$$

and $$S_1 = c \times L_1 \tag{7}$$

the equation (5) will be:

$$N \times L = N_1 \times L_1 \tag{8}$$

substituting (8) in (4), we obtain:

$$\frac{N}{e} = \frac{N_1}{e_1} \tag{9}$$

and from (6), (7) and (9)

$$\frac{e_1}{e} = \frac{N_1}{N} = \frac{S}{S_1} = \frac{L}{L_1} \tag{10}$$

As a numerical example for two stabilizing transformers with stack lengths of L=13 cm and $N_2$=460 turns and $L_1$=3 cm (conventional reactance) from (10) we obtain the values:

$$e_1 = \frac{13}{3} e \tag{11}$$

$$N_1 = \frac{13}{3} \times 460 = 1{,}994 \tag{12}$$

$$S_1 = \frac{3}{13} S \tag{13}$$

and therefore:

$$\frac{e_1}{S_1} = \left(\frac{13}{3}\right)^2 \frac{e}{S} = 18.78 \frac{e}{S} \tag{14}$$

With the core saturated, the term $$\frac{ld}{\mu \times c \times L}$$

can not be neglected, since value of $\mu$ decreases continually as the induction increases. Taking into account the grain orientation and that $ld = ld' + ld''$ and $ld_1 = ld'_1 + ld''_1$, $$\frac{ld}{\mu \times c \times L}$$

can be separated into two addends:

$$\frac{ld}{\mu \times c \times L} = C_1 \frac{ld'}{\mu_{90} \times c \times L} + C_2 \frac{ld''}{\mu_0 \times b \times L} \tag{15}$$

and thus, $$\frac{ld_1}{\mu \times c \times L_1} = C_3 \frac{ld_1'}{\mu_{90} \times c \times L_1} + C_4 \frac{ld_1''}{\mu_0 \times b \times L_1} \tag{16}$$

$\mu_0$ and $\mu_{90}$ being the relative permeabilities parallel to the grain orientation (vertical) and perpendicular to it (horizontal), respectively, and $C_1$, $C_2$, $C_3$ and $C_4$ constants.

With $\mu_0 >> \mu_{90}$, the $\mu_0$ fractions can be disregarded, and as the sections and lengths are equal in those where the flux is at 90°, $C_1 = C_3$ and $ld' = ld_1'$, therefore the term $$C_3 \frac{ld_1'}{\mu_{90} \times c \times L_1}$$

becomes $$\frac{L}{L_1} = 4.33$$

times greater than the term $$C_1 \frac{ld'}{\mu_{90} \times c \times L}.$$

Figure 12:
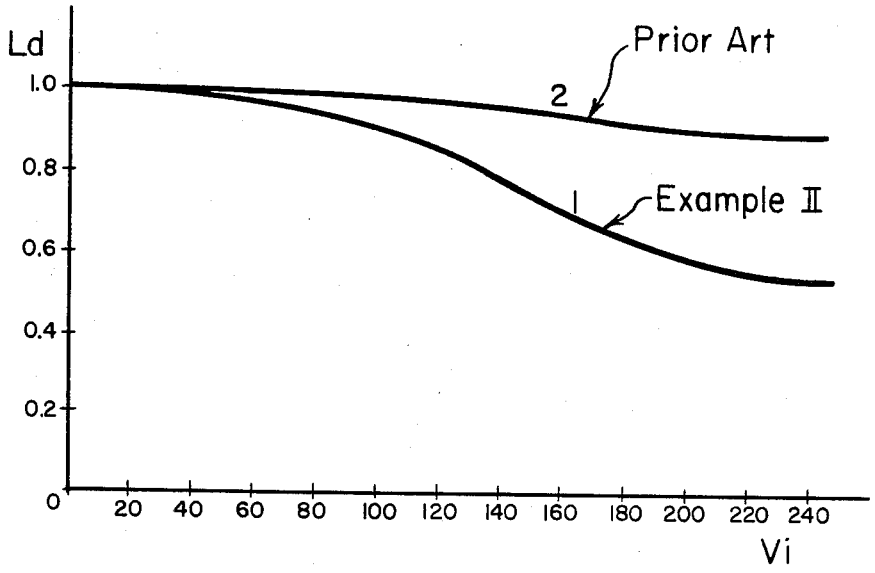
FIG. 12 is a graph of leakage inductance versus primary voltage for a stabilizing transformer according to the invention compared to a conventional transformer.
Figure 13:
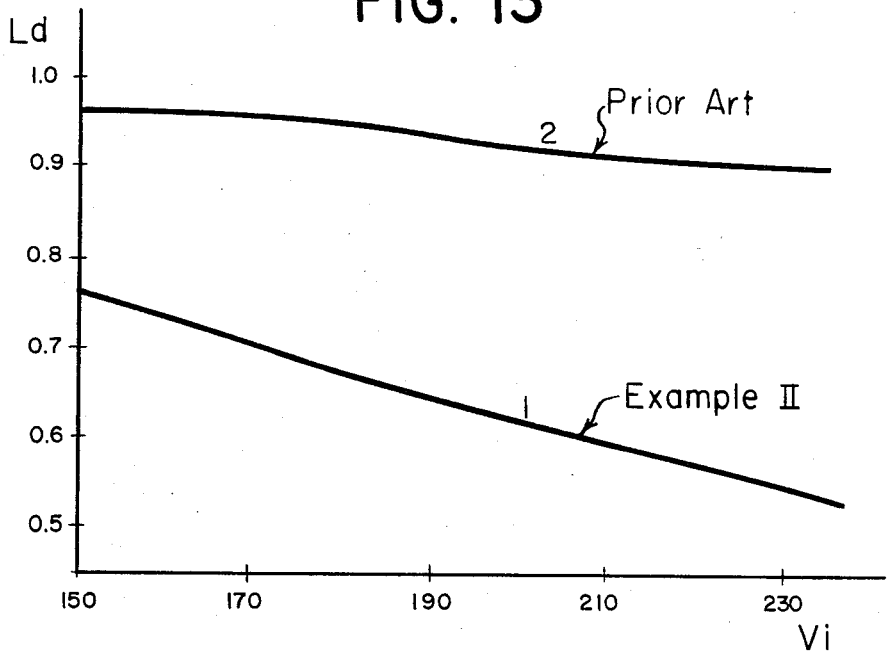
FIG. 13 is an expansion of the graph of FIG. 12.

Taking into account that the leakage inductance with an unsaturated core would have to have a limited value and similarly for equivalent reactances and that $$\frac{e1}{S_1} = 18.78 \frac{e}{S}$$

it is deduced that the influence of the term $$\frac{e}{b \times L}$$

is much greater in a conventional reactance of characteristics equivalent to the stabilizing transformer of the invention than the influence of the term in which the permeability is present, therefore the variation of the permeability due to induction would affect the Ld value much less, hence its decrease would be much smaller in the conventional reactance than in the stabilizing transformer of the invention. FIG. 12 shows the variation in leakage inductance with input primary voltage of the transformer of Example II in comparison with a transformer of the prior art design. FIG. 13 is an expansion of the graph of FIG. 12 for selected primary voltages.

The foregoing description will make clear to those skilled in the art the principles of the stabilizing transformer of the invention, the details of which may be modified without going beyond the scope of the invention as defined in the appended claims.

I claim:

1. In a gaseous discharge lamp stabilizing transformer having a square magnetic circuit formed from a plurality of planar laminations of low magnetic reluctance materials arranged parallel to each other in a stack to form a shell-like elongated core, a central inner member disposed in said core for support of windings of conductive wire, a primary winding and a secondary winding disposed side-by-side on said inner member and a magnetic shunt between said primary and secondary windings, the improvement comprising:

(a) said shell-like core having a stack length dimension perpendicular to the planes defined by said planar laminations which is greater than the length of a side of said laminations such that the axial length of said windings is less than the perimeter of the turns;

(b) said stack length dimension for a transformer of predetermined input and output operating characteristics and core magnetic cross-sectional area being maximized by making the differential of the combined value of the conducting material and the magnetic material with respect to said stack length dimension equal to zero, whereby the number of winding turns required is minimized and the regulating effect of leakage inductance variations is maximized.

2. The stabilizing transformer of claim 1 wherein said magentic shunt is formed from a stack of laminations of low reluctance magnetic material, the planes of which shunt laminations lie perpendicular to both the axial length of said windings and the planes of said core laminations and abutting said central inner support member.

3. The stabilizing transformer of claim 1 or 2 further comprising connecting a capacitor in series with said secondary winding.

4. In a gaseous discharge lamp stabilizing transformer having a rectangular magnetic circuit formed from a plurality of planar laminations of low magnetic reluctance materials arranged parallel to each other in a stack to form a shell-like elongated core, a central inner member disposed in said core for support of windings of conductive wire, a primary winding and a secondary winding disposed side-by-side on said inner member and a magnetic shunt between said primary and secondary windings, the improvement comprising:

(a) said shell-like core having a stack length dimension perpendicular to the planes defined by said planar laminations which is greater than the length of the longer side of said laminations such that the axial length of said windings is less than the perimeter of the turns;

(b) said stack length dimension for a transformer of predetermined input and output operating characteristics and core magnetic cross-sectional area being maximized by making the differential of the combined value of the conducting material and the magnetic material with respect to said stack length dimension equal to zero, whereby the number of winding turns required is minimized and the regulating effect of leakage inductance variations is maximized.

5. The stabilizing transformer of claim 4 wherein said magnetic shunt is formed from laminations of low reluctance magentic material strips lying perpendicular to both the axial length of said windings and the planes defined by said planar laminations and abutting said central inner support member.

6. The stabilizing transformer of claim 4 or 5 further comprising connecting a capacitor in series with said secondary winding.

* * * * *